United States Patent [19]

Lackey

[11] Patent Number: 4,962,293

[45] Date of Patent: Oct. 9, 1990

[54] MICROWAVE SUSCEPTOR FILM TO CONTROL THE TEMPERATURE OF COOKING FOODS

[75] Inventor: Donald V. Lackey, Salt Point, N.Y.

[73] Assignee: Dunmore Corporation, Newtown, Pa.

[21] Appl. No.: 408,566

[22] Filed: Sep. 18, 1989

[51] Int. Cl.[5] ..... H05B 6/80

[52] U.S. Cl. ..... 219/10.55 E; 219/10.55 F; 426/107; 426/234; 426/243; 99/DIG. 14

[58] Field of Search ..... 219/10.55 E, 10.55 F, 219/10.55 D; 426/107, 113, 234, 241, 243; 126/390; 99/451, DIG. 14; 206/524.3, 524.9, 524.1

[56] References Cited

U.S. PATENT DOCUMENTS

| | | | |
|---|---|---|---|
| 4,230,924 | 10/1980 | Brastad et al. | 219/10.55 E |
| 4,641,005 | 2/1987 | Seiferth | 219/10.55 E |
| 4,676,857 | 6/1987 | Scharr et al. | 426/107 |
| 4,713,510 | 12/1987 | Quick et al. | 219/10.55 E |
| 4,713,512 | 12/1987 | Wild et al. | 219/10.55 E |
| 4,735,513 | 4/1988 | Watkins et al. | 219/10.55 E |
| 4,777,053 | 10/1988 | Tobelmann et al. | 426/107 |
| 4,835,352 | 5/1989 | Sasaki et al. | 219/10.55 E |
| 4,883,936 | 11/1989 | Maynard et al. | 219/10.55 E |

*Primary Examiner*—Philip H. Leung
*Attorney, Agent, or Firm*—Haynes N. Johnson

[57] ABSTRACT

A metallic coated substrate capable of reaching a predetermined surface temperature upon being exposed to microwave energy of a known strength including a base, a metal coating on the base, the coating being formed in a plurality of discrete metal areas having predetermined surface resistivity, the size of the areas being below the arcing size for the surface resistivity, and the resisitivity being such that the predetermined surface temperature will be reached when the substrate is exposed to the microwave energy. Different areas on the base may contain discrete areas of different surface resistivity so that the different areas reach different temperatures. The spacing of the discrete areas may be varied so that the rate of energy emission from those areas differs.

21 Claims, 3 Drawing Sheets

MICROWAVE SUSCEPTOR FILM TO CONTROL THE TEMPERATURE OF COOKING FOODS

FIELD OF THE INVENTION

This invention relates to packaging material for foods which is usable in the microwave cooking of those foods. In particular, it relates to metal coated substrates, such as plastic film or paper, often called susceptor film, in which, due to newly-discovered microwave surface charge effects and reflectance-transmission-absorption characteristics of the metallic coating, controls the surface temperature reached by the film during cooking. By using this material, packages can be designed to reach, and remain at, a predetermined temperature and heat energy output.

BACKGROUND OF THE INVENTION

Many systems have been developed for controlling the extent to which food is heated and cooked in microwave ovens. These include aperture control to selectively heat different foods to different temperatures, such as found in Brown U.S. Pat. No. 3,219,460, Stevenson U.S. Pat. No. 3,547,661, Virnig U.S. Pat. No. 3,672,916, and Greenfield U.S. Pat. No. 4,080,524. Others use food-packaging materials directed to achieving cooking control by limiting the quantity of microwave radiation that can pass to the food. See, for example, Flautt U.S. Pat. No. 4,268,738. Others use microwave absorbent materials which heat when they receive radiation.

This prior work, however, is directed to controlling the quantity of microwave radiation, or resulting heat energy, to reach the food. It does not control the actual temperature reached by the package, and, so, the surface temperature reached by the food. My invention controls surface temperature plus total thermal energy, and does it by controlling the areas of, and surface resistivity of, discrete portions of metallized coatings formed on a dielectric film. This metallized coated film may be used to surround the food or as a surface upon which the food can rest. Accordingly, it serves to provide for surface cooking of food at a predetermined temperature.

BRIEF SUMMARY OF THE INVENTION

My invention is a type of metallized or metallic coated substrate which, when exposed to microwave radiation of a known intensity for a predetermined time, will reach a predetermined temperature and thermal energy output. That is, different films can be made which, under the same time and intensity conditions, will reach different, but predetermined, temperatures and thermal energy outputs. The film is useful, for example, where different foods are packaged together, and so are cooked under the same conditions, but require individually different cooking temperatures on their surfaces.

I have found that one can control the surface temperature and thermal energy output on a substrate, such as film or paper, coated with uniformly laid down, discrete metallic spots by varying the size, resistivity, and spacing of the spots. The temperature reached by the coated film is related to the resistivity of the deposited metal coating. By having different areas of the coated film with different resistivities of deposited metal of a controlled area, different temperatures can be reached in the different areas.

DETAILED DESCRIPTION OF THE INVENTION

Figure 1:
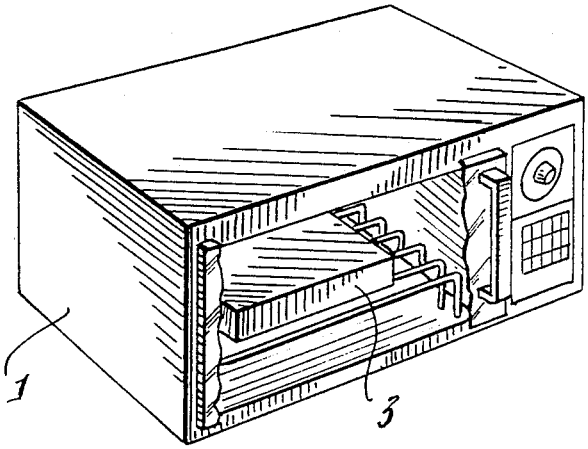
FIG. 1 is a perspective view of a microwave oven. A food package using my packaging material can be seen within the oven.

FIG. 1 shows one way of using my invention, in microwave cooking. Here, a food-containing package 3 within microwave oven 1 is being used for cooking the food. The package, shown in cross-section in FIG. 2, may include two types of food requiring different surface cooking temperatures, such as a pie 5 and a roast 7. The key to the temperature control is a unique bottom surface 9, better seen in FIGS. 7 and 8.

Figure 3:
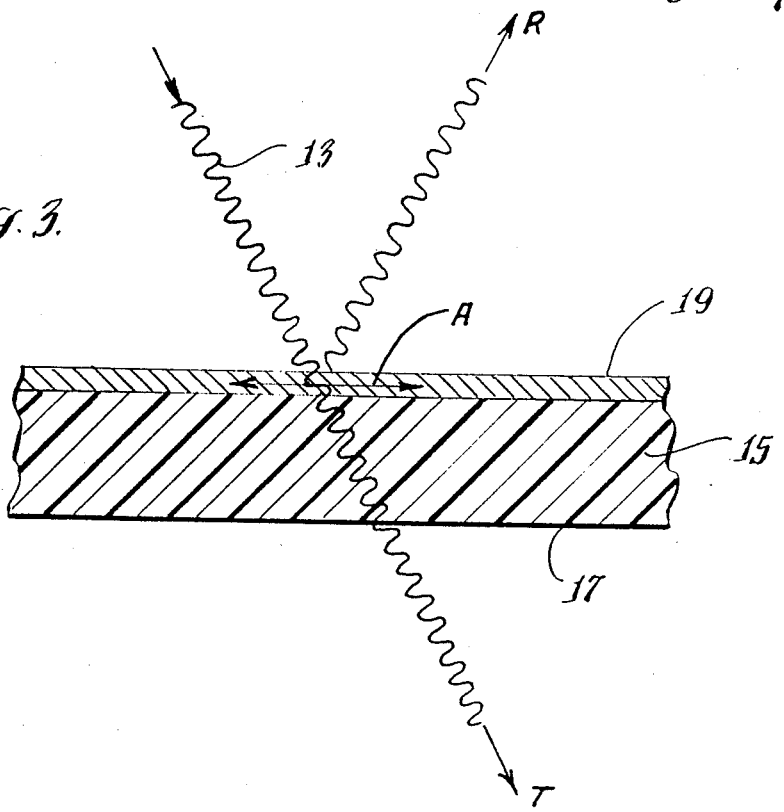
FIG. 3 is a diagram showing how high microwave energy hitting a metallic coating is reflected, transmitted, and absorbed.

Before discussing this bottom surface, however, it is best to consider the theoretical aspects of my temperature control system. FIG. 3 shows the thermal aspects when a beam of microwave energy 13 is directed at a continuously coated substrate 15, here a plastic film 17 with a metal coating 19, normally aluminum, sometimes called susceptor film. As can be seen from FIG. 3, a portion ("R") of the radiation energy is reflected from the surface; another portion ("T") is transmitted through the metal coating and film; and a third portion ("A") is absorbed. The absorbed portion is converted to thermal energy due to resistive loss ($I^2R$).

The percentages of the microwave energy which are reflected, transmitted, and absorbed will vary depending upon the electrical properties of the material, the frequency of the microwave energy, and the angle of incidence. Depending on the resistivity of the metallic coating, the total of the three percentages will be almost 100%.

Figure 4:
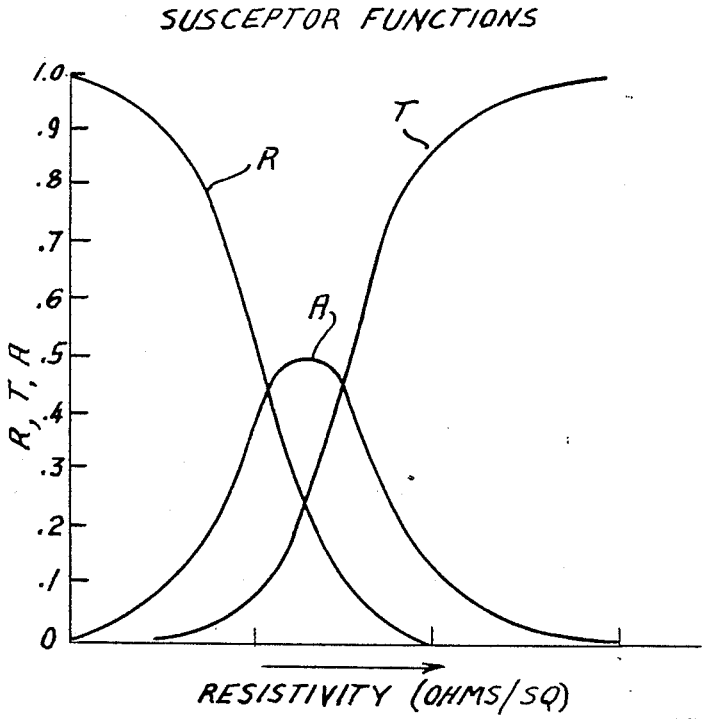
FIG. 4 is a representative plot of the coefficients of transmitted ("T"), reflected ("R"), and absorbed ("A") microwave energy as a function of electrical resistivity.

FIG. 4 is a representative plot of the coefficients of reflected, transmitted, and absorbed microwave energy as a function of resistivity. As can be seen by this graph, as the resistivity increases the amount of absorbed energy ("A") increases until the coefficients of transmitted ("T") and reflected ("R") energy become equal. At that point the amount which is absorbed decreases as does the amount which is reflected until there is essentially 100% transmission. Because the absorbed microwave radiation is converted to thermal energy due to resistive loss ($I^2R$), as the value of resistance changes, the rate at which heat is produced will change and thus temperature will change. Typical susceptor film used in some food packages today may have a resistance of about 50–150 ohms/square which results in no load surface temperatures of about 500–525° F. in a 600 watt oven. In a practical sense, to achieve lower surface temperatures, a lower resistivity of the metallic coating would be required.

However, it has been found that when the resistivity of a metallic coating such as aluminum becomes lower than about 50 ohms/square, a surface charge accumulates which results in severe arcing on the metal surface.

Figure 5:
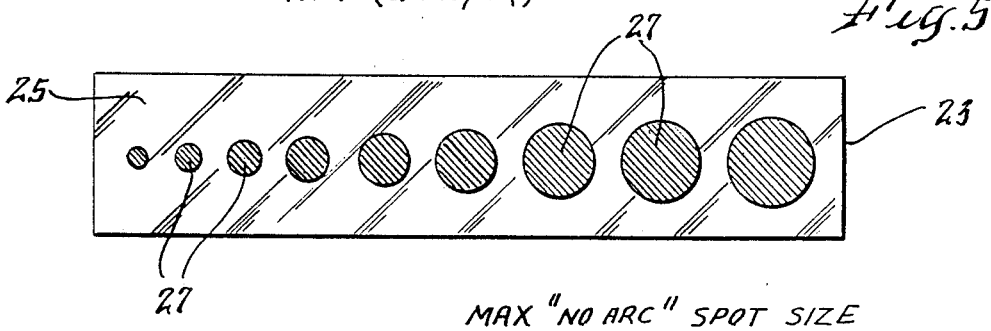
FIG. 5 is a test strip of packaging material of the type used by me to develop my packaging material.

I have found that arcing is reduced by reducing the surface area of the metal. FIG. 5 is illustrative of a series of experiments which I performed. This discloses a card 23 with an adhered film surface 25 carrying a series of metallized aluminum discs 27 which are of the same resistivity but of different diameters (different areas). When these are exposed to microwave radiation, all of those discs above a certain area will arc, and all of those below that area will not. In one particular example the aluminum resistivity was 2 ohms/square and was exposed to 600 watts of microwave energy. The disc areas ranged from 490 $mm^2$ to 32 $mm^2$, and arcing occurred on those discs having areas greater than 90$mm^2$.

As the thickness of the metal decreases, the resistance increases, the reflectance decreases, and the transmission increases. The residual of the total incident radiation becomes absorbed and converted to heat at a rate commensurate with resistive loss ($I^2R$). Depending on the resistivity of the aluminum coating and the power output of the microwave source, this aforementioned residual radiation may not be converted to heat as rapidly as it is arriving at the surface, resulting in a surface charge accumulation and arcing.

I have found that the accumulation of this surface charge can be avoided by adjusting the surface area of the metallic deposit relative to its resistivity and thereby preventing the surface charge from becoming critical with respect to arcing.

Figure 6:
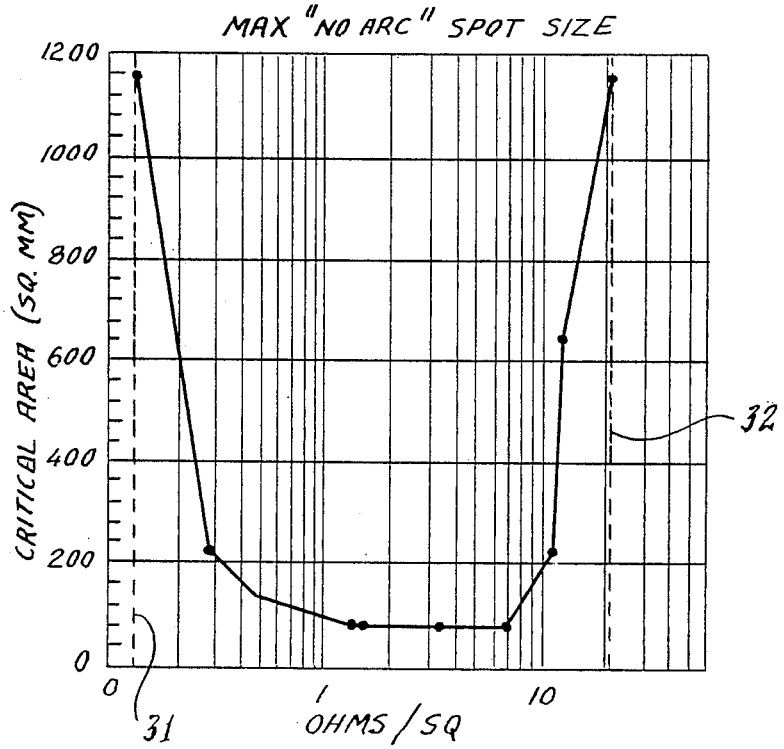
FIG. 6 is a curve plotting maximum area before arcing against the surface resistivity of metal coating, in this instance aluminum. The resistivity for a given metal is inversely related to the thickness of the metal.

Because resistivity is common to both the coefficients of the microwave incident energy and the conversion of this energy to heat, the area of a disc such as 27 can be greater with relatively high or low resistivity values as shown in FIG. 6.

FIG. 6 is a graph of the maximum "spot size" (area) of deposited aluminum before arcing is observed against resistivity in a 600 watt microwave oven. As can be seen, for a given microwave oven output, the curve 30 showing the maximum area without arcing begins high (to the left), drops down and becomes flat and then rises. In those portions of the curve 30 to the left of point 31 and to the right of point 32, the absorption, reflectance, and transmission of the incident microwave energy total 100% and the spot size approaches infinity. In the portion of the curve between 31 and 32, however, they do not total 100%. The difference is surface charge upon the metallic deposit. Curves similar to those of FIG. 6 can be drawn for ovens of other wattages and for other metals than aluminum. The curve normally used should be the one for the wattage usually found and, to allow a margin, it is best to operate slightly below the curve.

The metals used can be any of those normally employed with these films. They can, if desired, include ferromagnetic metals or alloys using them. I would also include electrically conductive polymers in my definition of "metals". These other materials would result in curves similar to curve 30 but of different dimensions. Ferromagnetic metals will affect the magnetic portion of the electromagnetic wave in the microwave oven and so could permit the spots to be bigger and allow one to operate somewhat above the curve 30 (as made for aluminum) without departing from my invention, since arcing is avoided.

Therefore, by controlling the resistivity of the metal deposit and the spot size, rather than using a continuous layer, one can maintain an area-resistivity combination such that it is on or below the curve 30, between points 31 and 32, and arcing is avoided. This means that the spots 27 will receive microwave energy and be heated but they will not, however, arc.

Figure 9:
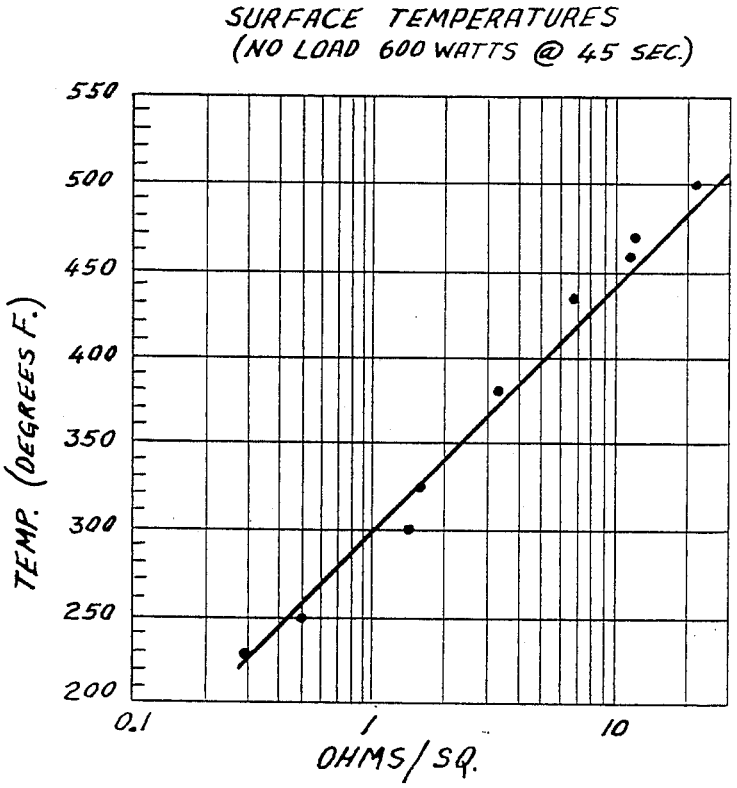
FIG. 9 is a curve showing the effect of varying resistivity upon no load surface temperature.

When discrete spots are subjected to a known intensity of microwave energy, the temperature which the spots will reach depends upon the surface resistivity. An example of this is shown in the graph of FIG. 9 which plots the temperature reached in 45 seconds in a 600 watt oven against surface resistivity. (Usually the spots will reach temperature in less than 45 seconds, by I have used this time in my testing in order to be sure that surface equilibrium has been reached.)

The total thermal output which a given area of discrete spot metal coated substrate will produce for a given time will depend upon the surface resistivity of the metallic spots, the percent of area coverage provided by the spots, and upon the strength of the microwave source. As a result, by providing a predetermined type of spot coverage, one can predetermine the thermal characteristics the surface will achieve for a given microwave oven power output; for ovens having larger or smaller power levels, the resistivity and spot size can be altered so as to arrive at the desired thermal effect.

These discrete spots can, then, be tailored to meet the cooking requirements of different foods.

Figure 2:
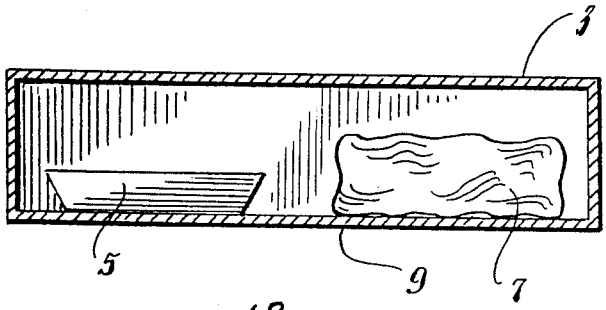
FIG. 2 is a cross-section through a typical package, showing two different foods inside, which require different cooking temperatures.
Figure 7:
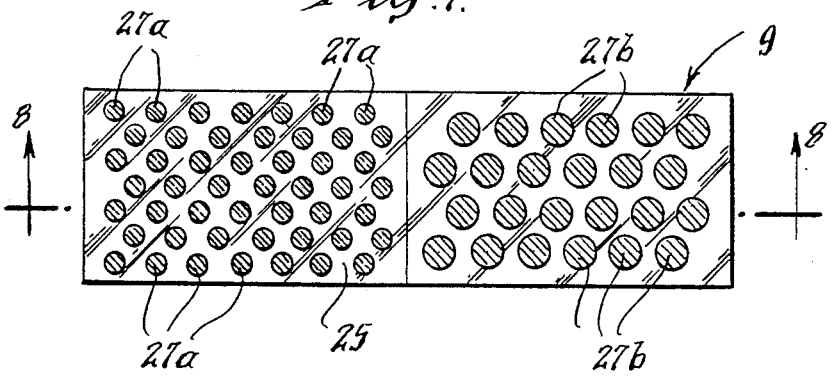
FIG. 7 is a plan view of my packaging material as it might be used in a package carrying foods which need to be cooked at different temperatures.
Figure 8:
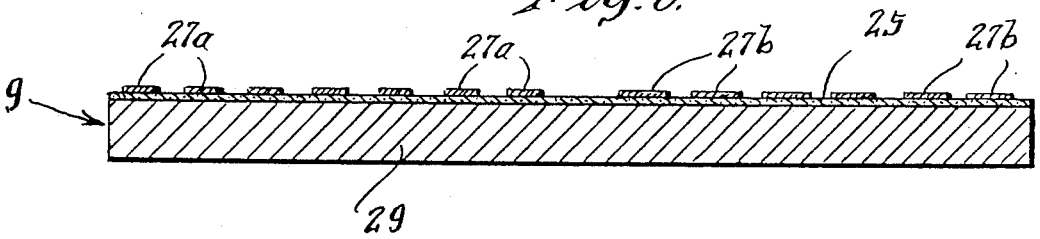
FIG. 8 is a cross-section on line 8—8 of FIG. 7.

FIGS. 7 and 8 show a type of bottom surface 9 that might be used for package 3 (FIG. 2). This would include a paperboard base 29, a film surface or substrate 25, and discrete spots **27*a* and 27*b* of aluminum deposits of different sizes. If we assume that the metallic deposit is of the same resistivity for both sets of spots and that the smaller spots 27*a* have a lesser percentage film coverage than the larger spots 27*b*, then the area with 27*a* spots will generate less total heat energy per unit area for a given time of exposure to microwave than will the area of spots 27*b***.

If the spots **27*a* are under the pie 5 in the package and the larger spots 27*b*** are under the meat, then the surface of the meat will receive more thermal energy than will the pie. This means that a package can be provided with foods of different heating requirements and be cooked, concurrently, in the same microwave oven. The quantity of energy for surface cooking of different foods is best determined by experiment. A pie crust, for example, probably requires less energy for it to remain crisp while the pie is cooking than does a roast that is being browned.

By way of example, if the spots are formed of aluminum with a surface resistivity of 2.0 ohms/square, they will reach a temperature of 340 ° F. (FIG. 9). If spots **27*a* are 5 mm in diameter (with an area of 19.6 $mm^2$; and spots 27*b* are 10.4 mm in diameter (with an area of 85 $mm^2$; these areas will be below the maxima shown by curve 30 of FIG. 6 for surface resistivity of 2.0 ohms/-square and, so, will not arc. If spots 27*a* have a surface coverage of 34% of area and spots 27*b*** have a coverage of 68% of area and both are subjected to microwave energy of 600 watts for equal amounts of time, then both will reach the same temperature, but the smaller spot area will have a total thermal output that is one-half that of the larger spot area.

An alternative system of discrete spots can be used. The spots can be all of the same size and their thickness (resistivity) varied. This resistivity can be interpreted in terms of ohms/square, and a typical curve for ohms/-square against temperature for a given time of microwave exposure is shown in FIG. 9. Thus, spots 27*a* under the pie could have a surface resistivity of 2.0 ohms/square, giving a temperature of 340° F., and spots 27*b* under the roast could have a surface resistivity of 5.0 ohms/square, giving a temperature of 400° F. (FIG. 9). The area of spots 27*b* would have to be within curve 30 of FIG. 6, i.e., no greater than 90 $mm^2$.

Alternatively, both size and resistivity can be varied, which would allow for infinite combinations of temperature and total thermal output. Although aluminum is usually preferred, other metals can be used if desired simply by following the above principles.

In the production of current microwave susceptor films, techniques such as vapor deposition, for applying a thin metallic layer to a substrate, are well known. The metallic coated substrate of my invention can be made by metallizing, i.e., using vapor deposition techniques, or be coated by other techniques. The substrate can be plastic, paper, or other material. Typically50Å–70Å aluminum is applied to a plastic substrate, such as polyester, polycarbonate, or other suitable material, in a continuous uniform coating.

For the sake of the present invention, the metal is not a continuous coating but discrete spots of a predetermined size, thickness, and percentage of surface covering. This discrete coating is preferably accomplished by vacuum metallizing through perforations in a flexible band that is in contact with the surface of the film to be coated. Alternatively, this discrete metallic coating could be printed on the surface of the substrate by using conventional printing processes, or continuously coated film could be further processed in such a way as to selectively remove the metallic coating leaving discrete areas of metallic coating.

An example of a specific coating would be aluminum alloy 1100 that is vapor deposited on a 12 $\mu m$ polyester film in a "staggered center" spot pattern having 2.87 spots per $cm^2$ and a total metal coverage of 53.5% with a surface resistivity of 2.0 ohms/square. Exposed to a 600 watt microwave oven, the no load surface temperature would reach 340° F. and would have a thermal output of about 59 watts/min/$cm^2$.

My invention has been shown in use in food packaging. It can, of course, be used in other situations where thermal control in a microwave field is desired. Examples of these would include (1) Tamper evident labels which have a heat sensitive coating that require a microwave susceptor material to preclude undetected removal of the label by using microwave radiation to soften the label adhesive. (2) Self-venting packages which employ a strip of microwave susceptor material in a seal area that produces enough heat to open the seal upon initial exposure to microwave energy, thus avoiding a potentially hazardous buildup of steam pressure in the food package. (3) Reusable cooking panels which could be purchased separately and placed on or around foods to assist in their cooking, washed, and reused as needed.

I claim:

1. A metallic coated substrate capable of reaching a predetermined surface temperature upon being exposed to microwave energy of a known strength, said substrate including a base of sheet material, a metal coating on said base, said coating being formed in a plurality of discrete metal areas having a predetermined surface resistivity, the size of individual said discrete metal areas being below the intra-area arcing size for said surface resistivity, and said resistivity being such that said discrete metal areas will come to said predetermined surface temperature when said coated substrate is exposed to said microwave energy.

2. A metallic coated substrate as set forth in claim 1 in which said surface resistivity is determined by the thickness of said metal coating.

3. A metallic coated substrate as set forth in claim 1 in which said discrete metal areas are uniformly distributed upon said base.

4. A metallic coated substrate as set forth in claim 3 in which said discrete metal areas are of uniform size.

5. A metallic coated substrate as set forth in claim 1 in which said discrete metal areas cover a predetermined percentage of the total area of said base, whereby a predetermined rate of thermal energy is achieved.

6. A metallic coated substrate as set forth in claim 5 in which said discrete metal areas are of uniform size.

7. A metallic coated substrate as set forth in claim 1 in which said metal areas are aluminum.

8. A metallic coated substrate as set forth in claim 1 in which said discrete metal areas include ferromagnetic metal.

9. A metallic coated substrate as set forth in claim 1 in which said base is a plastic film.

10. A metallic coated substrate as set forth in claim 1 in which said base is paper.

11. A metallic coated substrate as set forth in claim 1 and capable of reaching a second said predetermined surface temperature, said substrate including a second metal coating on a different portion of said base, said second coating being formed of a second plurality of discrete metal areas having a different predetermined surface resistivity from that of said first-named metal coating, the size of said areas being below the arcing size for said surface resistivity, and said resistivity being such that a second and different said surface temperature will be reached when said second plurality of discrete metal areas is exposed to said microwave energy, whereby said substrate will have areas that reach different surface temperatures during exposure of said base to said microwave energy.

12. A metallic coated substrate as set forth in claim 11 in which said surface resistivity is determined by the thickness of said metal coating.

13. A metallic coated film as set forth in claim 11 in which said discrete metal areas are uniformly distributed upon said base.

14. A metallic coated film calibrated to reach a predetermined temperature while being exposed to microwave energy of a known strength, said film including a plastic base, a metal coating on said base, said coating being formed in a plurality of discrete metal areas having a predetermined surface resistivity, said resistivity being such that the said metal areas will reach said predetermined temperature when said film is exposed to said microwave energy, and the size of individual said discrete metal areas being below the intra-area arcing size for said surface resistivity.

15. A metallic coated film as set forth in claim 14 and including a second plurality of said discrete metal areas on said base, removed from said first-named said plurality, said second plurality of said discrete metal areas having a different surface resistivity than that of said first-named plurality, and the size of individual said discrete metal areas being below the intra-area arcing size for said surface resistivity, whereby the surface temperature reached by said second plurality of said discrete metal areas will be different than the surface temperature reached by said first-named plurality.

16. A metallic coated film as set forth in claim 14 and including a second plurality of said discrete metal areas on said base, removed from said first-named said plurality, said second plurality of said discrete metal areas having the same said predetermined rate as said first said plurality but being uniformly distributed on said base with a different spacing so as to produce an emission of said energy at a different predetermined rate per unit area.

17. A metallic coated film as set forth in claim 14 and including a second plurality of said discrete metal areas on a portion of said base different from the portion of said base carrying said first-named said plurality, said second plurality of said discrete metal areas being of a different size than the size of said discrete areas of said first-named plurality, whereby said energy is emitted at a different predetermined rate per unit area by said second plurality.

18. A metallic coated film as set forth in claim 14 and including a second plurality of said discrete metal areas on a portion of said base different from the portion of said base carrying said first-named said plurality, said second plurality of said discrete metal areas having a total area per unit area different from that of said first-named plurality.

19. In a package for containing foods for microwave cooking, said package including top, bottom, and side portions, that improvement including an inner surface on said bottom portion formed of a metallic coated substrate capable of reaching a predetermined surface temperature upon being exposed to microwave energy of a known strength, said substrate including a base of sheet material, a metal coating on said base, said coating being formed in a plurality of discrete metal areas having a predetermined surface resistivity, the size of individual said discrete metal areas being below the intra-area arcing size for said surface resistivity, and said resistivity being such that the said discrete metal areas will reach said predetermined surface temperature when said film is exposed to said microwave energy.

20. In a package for containing foods for microwave cooking as set forth in claim 19, a second metal coating on a different portion of said base, said second coating being formed of a second plurality of discrete metal areas having a different predetermined surface resistivity from that of said first-named metal coating, the size of individual said discrete metal areas being below the arcing size for said surface resistivity, and said resistivity being such that said second plurality of said discrete metal areas will reach a second and different said surface temperature when said second plurality of discrete metal areas is exposed to said microwave energy, whereby said substrate will have areas that reach different surface temperatures during exposure of said base to said microwave energy.

21. A coated substrate capable of reaching a predetermined surface temperature upon being exposed to microwave energy of a known strength, said substrate including a base of sheet material, a coating of electrically conductive material on said base, said coating being formed in a plurality of discrete areas having a predetermined surface resistivity, the size of individual said discrete areas being below the intra-area arcing size for said surface resistivity, and said resistivity being such that said discrete areas will come to said predetermined surface temperature when said coated substrate is exposed to said microwave energy.

* * * * *